US010602280B2

(12) United States Patent
Rapitsch et al.

(10) Patent No.: US 10,602,280 B2
(45) Date of Patent: Mar. 24, 2020

(54) CONDENSER MICROPHONE

(71) Applicant: AUSTRIAN AUDIO GmbH, Vienna (AT)

(72) Inventors: Dieter Rapitsch, Wr. Neustadt (AT); Christoph Frank, Vienna (AT); Mathias Balac, Vienna (AT)

(73) Assignee: Austrian Audio GmbH, Vienna (AT)

( * ) Notice: Subject to any disclaimer, the term of this patent is extended or adjusted under 35 U.S.C. 154(b) by 0 days.

(21) Appl. No.: 16/361,958

(22) Filed: Mar. 22, 2019

(65) Prior Publication Data

US 2019/0297430 A1 Sep. 26, 2019

(30) Foreign Application Priority Data

Mar. 22, 2018 (EP) ..... 18163360

(51) Int. Cl.

| | |
|---|---|
| ***H04R 19/04*** | (2006.01) |
| ***H04R 7/18*** | (2006.01) |
| ***H04R 19/01*** | (2006.01) |
| ***H04R 19/00*** | (2006.01) |
| ***H04R 31/00*** | (2006.01) |

(52) U.S. Cl.

CPC ..... *H04R 19/04* (2013.01); *H04R 7/18* (2013.01); *H04R 19/005* (2013.01); *H04R 19/016* (2013.01); *H04R 31/006* (2013.01); *H04R 2201/003* (2013.01); *H04R 2499/11* (2013.01)

(58) Field of Classification Search

CPC ..... H04R 3/005; H04R 7/18; H04R 19/005; H04R 19/016; H04R 19/04; H04R 2201/003; H04R 2499/11

USPC ..... 381/113, 116, 369, 174, 175, 190.191, 381/398

See application file for complete search history.

(56) References Cited

U.S. PATENT DOCUMENTS

| | | | | |
|---|---|---|---|---|
| 5,600,610 | A * | 2/1997 | Hill | B06B 1/0292 367/181 |
| 2006/0140423 | A1* | 6/2006 | Tanabe | H04R 19/016 381/174 |
| 2007/0025570 | A1* | 2/2007 | Yonehara | H04R 19/04 381/174 |
| 2011/0013788 | A1* | 1/2011 | Izuchi | H04R 19/016 381/174 |
| 2013/0044899 | A1 | 2/2013 | Barber et al. | |

FOREIGN PATENT DOCUMENTS

| | | |
|---|---|---|
| JP | 58-151799 A | 9/1983 |

* cited by examiner

*Primary Examiner* — Huyen D Le
(74) *Attorney, Agent, or Firm* — Kolisch Hartwell, P.C.

(57) ABSTRACT

A condenser microphone, including at least one diaphragm, at least one electrode assigned to the diaphragm, comprising at least one ring-shaped insulator holding the electrode, comprising at least one diaphragm ring holding the diaphragm, and a holding ring holding the components mentioned. The mechanical and electrical properties of the condenser microphone are improved where the holding ring includes ceramic material. Preferably, the diaphragm ring and/or the ring-shaped insulator also consist(s) of ceramic material. With further preference, the ceramic material is zirconium oxide.

11 Claims, 4 Drawing Sheets

PRIOR ART

CONDENSER MICROPHONE

BACKGROUND

The invention relates to a condenser microphone according to the preamble of claim 1 and US 2013/0044899 A1.

Said document, the content of which is incorporated by reference in the content of the present application, discloses a dual backplate electret microphone in a housing. The diaphragm is adhesively bonded on a ceramic ring with a partly metallized surface and is inserted with that from the rear side into the microphone housing, in which the front electrode has already been introduced, and is fixed together with a circular carrier plate, which carries the electronics and closes off the microphone toward the rear, and supports for the back electrode, by the flanging of the edge of the housing.

SUMMARY

JPS 58-151799 from 1982, which relates to a specific ring-shaped electret microphone, discloses succinctly in a subordinate clause the fact that the diaphragm and the electrode can be combined with ceramic etc.

Condenser microphones can be either so-called "true" condenser microphones, in which the polarization voltage is applied externally, or so-called electret microphones, which have diaphragms or electrodes which are permanently charged in the course of the production method. Furthermore, the invention relates to both capsules or microphones comprising one diaphragm and those comprising two diaphragms.

Extreme requirements are made of the materials used for microphones, referred to hereinafter in summary as "condenser microphone", in particular with regard to their electrical conductivity, but also with regard to their mechanical properties. The electrically conductive elements usually consist of brass, which in many cases is coated with gold at least at the crucial parts of the surface and has a modulus of elasticity of approximately 100 GPa; the density of the material is around 8000 kg/m$^3$ and is therefore very high.

As insulating material, polyoxymethylene (POM) is usually used, the modulus of elasticity of which is less than 3 GPa and the density of which is only approximately 1.4 kg/m$^3$. The electrical resistivity is $10^{13}$ Ωm. POM absorbs water to a relatively small extent, approximately 0.2% by weight, but this nevertheless leads to a decrease in the insulating properties.

There are then applications in which the use of an excellently insulating and nevertheless mechanically very stiff material would be useful. One component to which this is particularly applicable is the holding ring which fixes the diaphragm ring and which, under certain circumstances, is also used to fix or to press together various other components in the capsule.

It is an aim and objective of the invention to specify such a material.

According to the invention, a ceramic material, in particular zirconium oxide ($ZrO_2$), is provided for such a material zirconium oxide is stiffer than brass with a modulus of elasticity of approximately 200 GPa and insulates almost as well as POM with a resistivity of at least $10^{11}$ Ωm and moreover affords the advantage of absorbing no moisture.

Since the density of zirconium oxide is 6000 kg/m$^3$ it is very dense and the corresponding component is correspondingly heavy, which has the advantage that with this ring it is possible to use stiffer rubber materials as mechanical insulation for structure-borne sound insulation by comparison with the prior art; said stiffer rubber materials have higher Shore hardnesses and are significantly more durable than the materials that can be used in the prior art.

The dependent claims relate to advantageous developments and variants. In this regard, in one development, advantageously, the diaphragm ring is screwed to the ring-shaped insulator by means of ring screws which preferably consist of ceramic material, particularly preferably of the same ceramic material as the holding ring. It is also advantageous if diaphragm ring and insulator consist of this material. As a result, the mechanical strength and the moisture tolerance of the ceramic material are fully utilized and handling with solvent-containing adhesives is avoided. All thermal problems owing to different coefficients of expansion and/or creepage of the adhesive are also reliably avoided.

In one advantageous variant, the microphone has two electrodes with the end faces thereof situated opposite one another, and the ring-shaped insulators assigned to them are connected to one another by means of at least one spacer and with through screws. Said through screws can be provided instead of and/or in addition to the ring screws. In this regard, it is possible to construct backplate microphones having excellent mechanical and acoustic properties.

One preferred configuration of this variant provides for both electrodes to be held by a common ring-shaped insulator. This makes it possible to construct the microphone in an extremely flat fashion.

BRIEF DESCRIPTION OF THE DRAWINGS

Independently of the other configurations, in a backplate microphone it is possible for both electrodes to be held by a common ceramic holding ring, thereby saving component parts and structural height.

It is preferred for the ceramic material to be zirconium oxide.

The invention is explained in greater detail below with reference to the drawing, in which.

DETAILED DESCRIPTION

Figure 1:
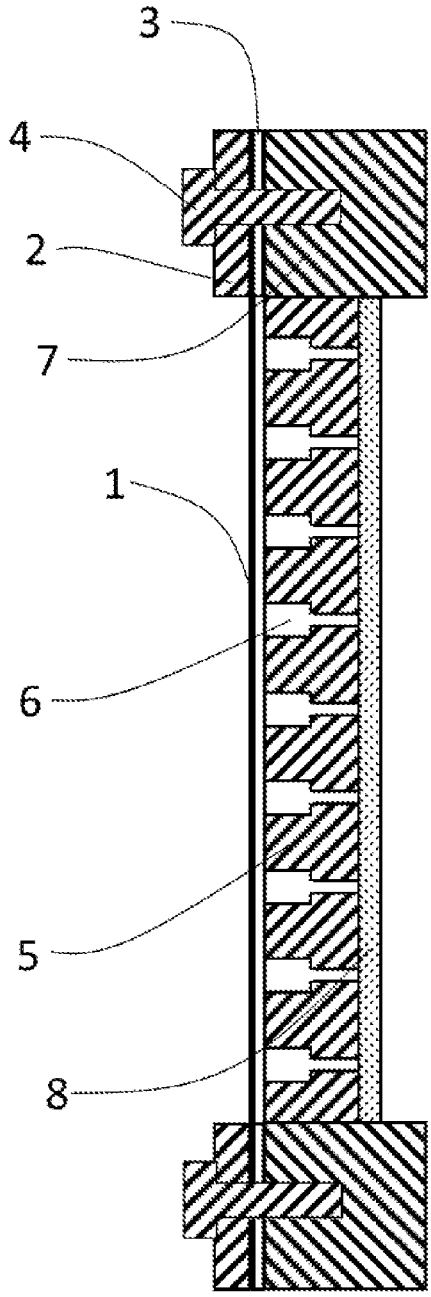
FIG. 1 shows a purely schematic section through the most essential components of a condenser microphone, namely electrode and diaphragm.

FIG. 1 shows, in a schematic axial section, a microphone in accordance with the prior art: a diaphragm ring 2 clamps a diaphragm 1 by means of an insulating spacer ring 3 and a ring-shaped insulator 7 at a distance above a disk-shaped electrode 5. Said electrode 5 has openings 6 connecting the interspace between the electrode and the diaphragm to the space on the other side of the electrode. There a so-called acoustic friction 8, for example a spun yarn or a foam, is provided, which serves for tuning the microphone. All this is prior art and needs no further explanation.

It is advantageous that the diaphragm ring 2 and/or the ring-shaped insulator 7 also consist(s) of ceramic material. They are connected to one another by means of screws 4, if appropriate composed of electrically insulating material, in particular likewise ceramic material, and thus clamp in the diaphragm 1.

Figure 2:
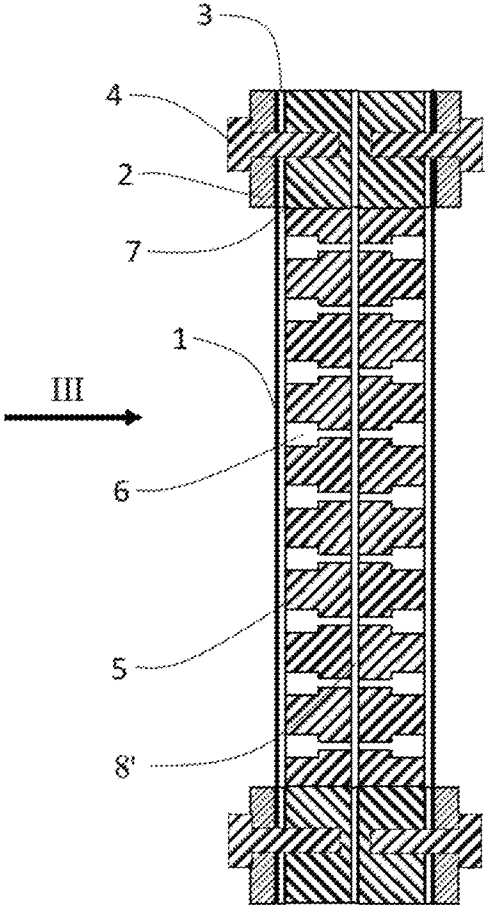
FIG. 2 shows a corresponding section through a condenser microphone with two electrodes and diaphragm.

FIG. 2 shows the situation in the case of a microphone with two diaphragms. In principle, such a microphone consists of two microphones each comprising a diaphragm 1, which are connected to one another in a manner facing electrode-to-electrode. In this case, the electrodes are at a short distance from one another. This distance is determined by the role of the acoustic friction, which in this case is implemented by the disk-shaped cavity or slot 8' thus formed between the mutually facing end faces of the two electrodes 5.

In the exemplary embodiment illustrated, the two microphone parts are appropriately connected to one another in a manner not shown (e.g. by means of the housing or the capsule and/or the further components) or are held in this position, if appropriate with an intermediate ring (not shown). It is possible, of course, to connect the two components by means of at least one spacer and through screws in order to facilitate their handling and mounting. Said through screws can be used instead of the ring screws 4, or else in addition thereto. Moreover, it is possible to hold both electrodes with a ring-shaped insulator or to ensure the illustrated configuration in the capsule after, if appropriate progressive, introduction by means of fixed clamping. With knowledge of the invention, it is a straightforward matter for the person skilled in the art to choose the appropriate embodiments here for the individual fields of application.

Figure 3:
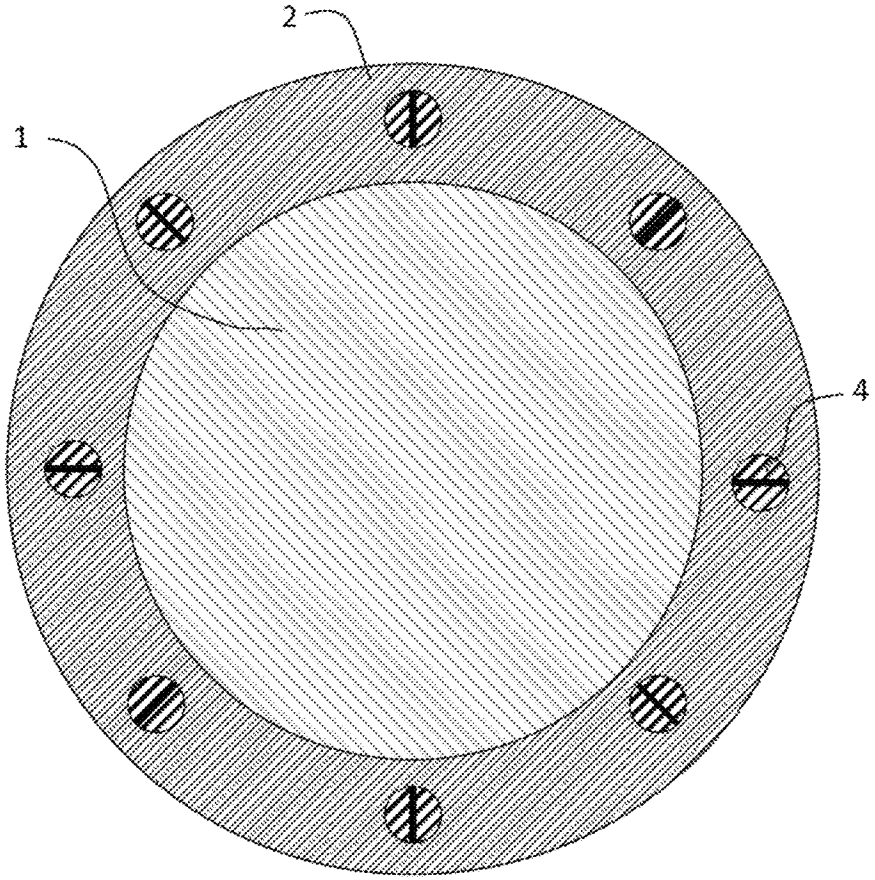
FIG. 3 shows a plan view in the direction of the arrow III from FIG. 2.

FIG. 3 shows a plan view in the direction of the arrow III from FIG. 2; the diaphragm ring 2, the screws 4 and the diaphragm 1 are readily discernible.

Figure 4:
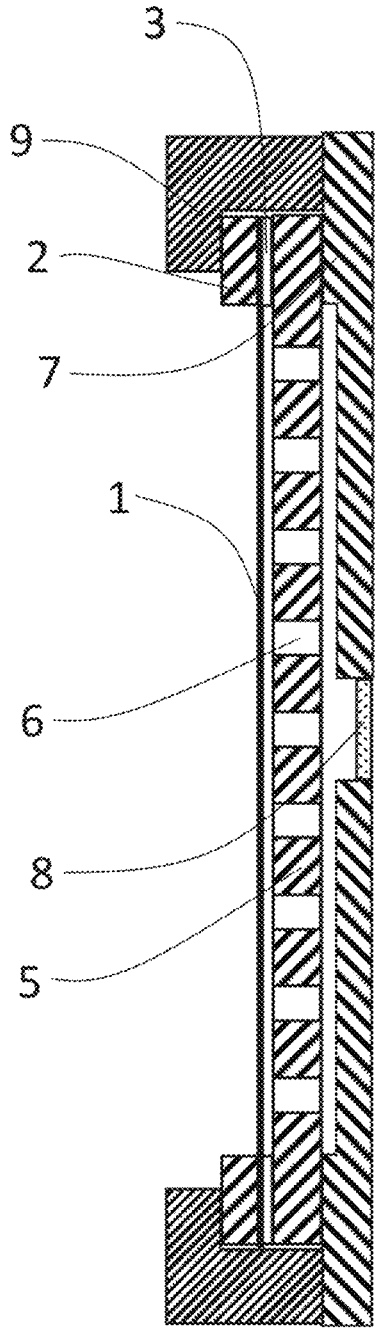
FIG. 4 shows a variant of FIG. 1, and FIG. 5 and FIG. 6 show a variant of FIGS. 2 and 3.

FIG. 4 shows, purely schematically, a variant of FIG. 1 with a holding ring 9 composed of ceramic material and an insulating disk 7 on the rear side of the diaphragm 1, which firstly, together with the holding ring 9, holds the electrode and the diaphragm 1 together with its rings and secondly fixes an acoustic friction 8, illustrated as dotted, permeable material, for example by means of adhesive bonding or screws (not illustrated).

Figure 6:
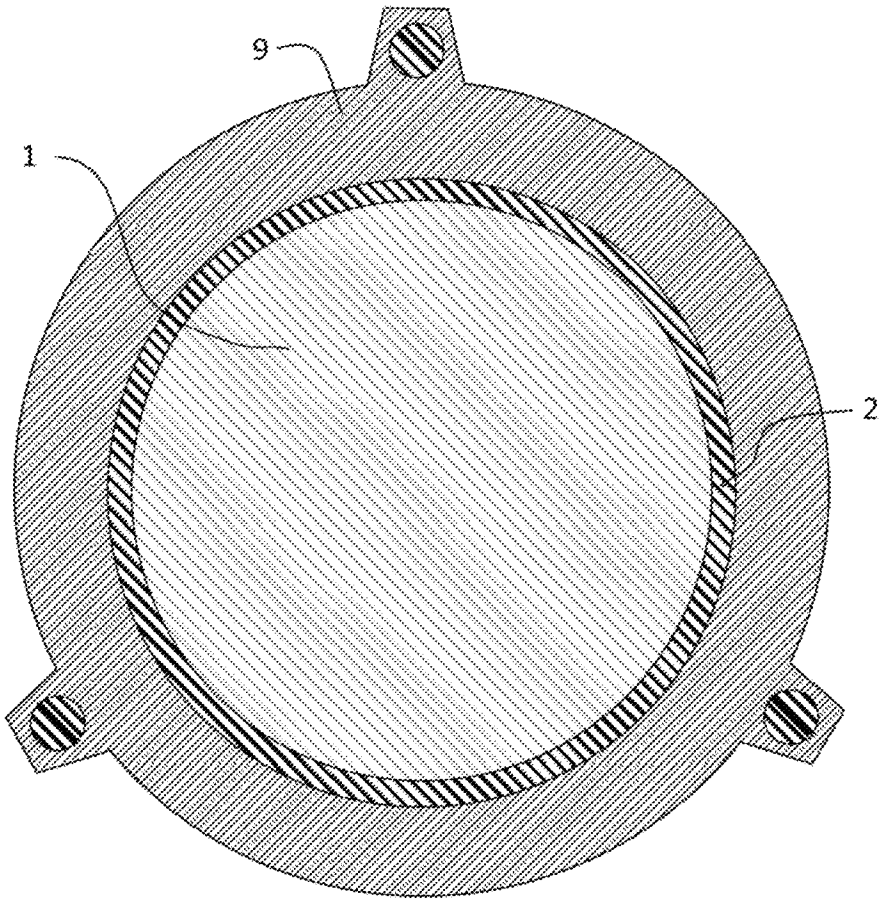
Figure 5:
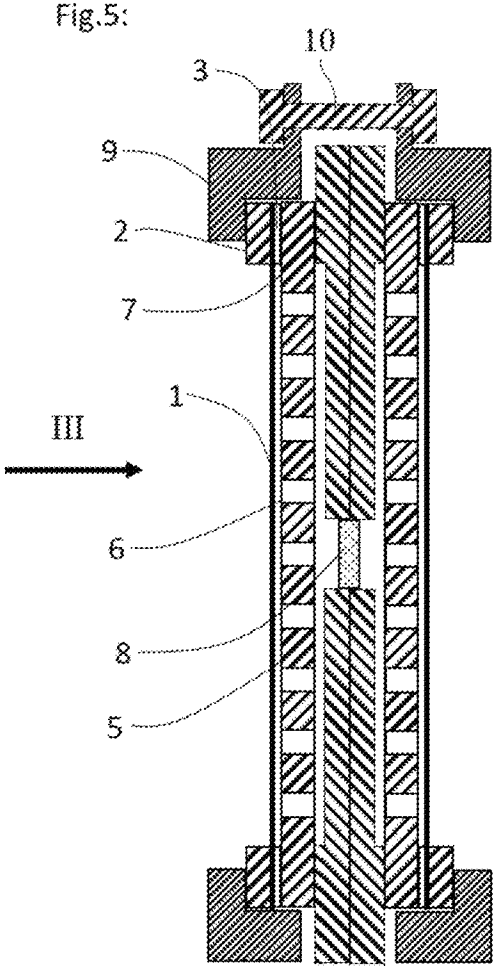

FIGS. 5 and 6 analogously show a dual embodiment similar to that from FIGS. 2 and 3, once again with a ceramic holding ring 9. The latter has radial projections (lugs) having through holes for through screws 10, which thus fix the entirety of the components mentioned. Here, however, instead of the slot friction 8', an acoustic friction 8 embodied as spun yarn or the like is provided, which can be freely combined and/or exchanged.

Generally it shall also be pointed out that the insulator 7 need only generally be ring-shaped, in the sense that it surrounds and holds the electrode 5 at the circumference thereof and in the sense that it cooperates with the diaphragm ring 2 in order to hold the diaphragm 1. Otherwise it can be adapted to the respective installation situation and have corresponding projections, shoulders, lugs, indentations, etc.

The invention can be modified in a variety of ways. In this regard, the ring screws 4 can also consist of ceramic material, they can be embodied with countersunk heads that descend completely into cutouts in the respective ring, and suchlike.

In the description and the claims, the terms "at the front", "at the back", "at the top", "at the bottom" and so on are used in their common form and with reference to the object in the customary use position thereof. In other words, in the case of a gun, the muzzle of the barrel is "at the front", the breach or slide is moved toward the "back" by the explosion gases, etc.

It shall also be pointed out that in the description and the claims, indications such as "lower region" of a suspension, reactor, filter, construction, or of a device or, very generally, of an object, means the lower half and in particular the lower quarter of the total height, and "lowest region" means the lowest quarter and in particular an even smaller part; while "middle region" means the middle third of the total height (width-length). All these indications have their common meaning, applied to the intended position of the object considered.

In the description and the claims, "substantially" means a deviation of up to 10% of the indicated value, if it is physically possible, both downward and upward, otherwise only in the expedient direction; for indications of degrees (angle and temperature), this is therefore taken to mean±10°.

All indications of quantities and indications of proportions, in particular those for delimiting the invention, provided that they do not concern the concrete examples, should be understood with a tolerance of ±10%, thus for example: 11% means: from 9.9% to 12.1%. In the case of designations in the German text such as: "ein Lösungsmittel" ["a solvent"], the German word "ein" ["a"; "an"; "one"] should not be regarded as a numeral but rather as a pronoun, unless something to the contrary is clear from the context.

The term "combination" or "combinations", unless indicated otherwise, stands for all kinds of combinations, preceding from two of the relevant constituents up to a multiplicity of such constituents; the term "containing" also stands for "consisting of".

The features and variants indicated in the individual configurations and examples can be freely combined with those of the other examples and configurations and be used in particular for characterizing the invention in the claims without mandatory concomitant inclusion of the other details of the respective configuration or of the respective example.

List of reference signs:

| | |
|---|---|
| 01 | Diaphragm |
| 02 | Diaphragm ring |
| 03 | Spacer ring |
| 04 | Ring screw(s) |
| 05 | Electrode |
| 06 | Holes |
| 07 | Insulator |
| 08 | Acoustic friction |
| 08' | Friction as slot |
| 09 | Holding ring |
| 10 | Through screws |

What is claimed:

1. A condenser microphone, comprising:

at least one diaphragm;

at least one electrode associated with the diaphragm;

at least one annular insulator holding the electrode;

at least one diaphragm ring holding the diaphragm; and a retaining ring that in cooperation with the annular insulator secures the diaphragm ring, the diaphragm, and the electrode;

wherein the retaining ring consists of a ceramic material.

2. The condenser microphone of claim 1, wherein both the diaphragm ring and the annular insulator include ceramic materials.

3. The condenser microphone of claim 1, wherein the diaphragm ring and the annular insulator are fastened together by means of screws.

4. The condenser microphone of claim 3, wherein the screws include a ceramic material.

5. The condenser microphone of claim 4, wherein the screws include the same ceramic material as the retaining ring.

6. The condenser microphone of claim 1, comprising two electrodes, each electrode being held by a different annular insulator, with the annular insulators being secured by two ceramic retaining rings connected to one another using screws so that the end faces of the two electrodes are disposed opposite one another.

7. The condenser microphone of claim 1, comprising two electrodes, both electrodes being held by a common annular insulator so that the end faces of the two electrodes are disposed opposite one another.

8. The condenser microphone of claim 1, comprising two electrodes, both electrodes being held by a common ceramic retaining ring so that the end faces of the two electrodes are disposed opposite one another.

9. The condenser microphone of claim 1, wherein the ceramic material is zirconium oxide.

10. A condenser microphone, comprising:

at least one diaphragm;

at least one electrode associated with the diaphragm;

at least one annular insulator holding the electrode;

at least one diaphragm ring holding the diaphragm; and a retaining ring that in cooperation with the annular insulator secures the diaphragm ring, the diaphragm, and the electrode;

wherein the retaining ring, diaphragm ring, and the annular insulator include ceramic materials.

11. A condenser microphone, comprising:

at least one diaphragm;

at least one electrode associated with the diaphragm;

at least one annular insulator holding the electrode;

at least one diaphragm ring holding the diaphragm; and a retaining ring that in cooperation with the annular insulator secures the diaphragm ring, the diaphragm, and the electrode;

wherein the retaining ring includes a ceramic material; and wherein the diaphragm ring and the annular insulator are fastened together by means of screws that include the same ceramic material as the retaining ring.

* * * * *